United States Patent [19]

Telle

[11] Patent Number: 4,863,161

[45] Date of Patent: Sep. 5, 1989

[54] EXERCISE ISOKINETIC APPARATUS

[76] Inventor: Jerome R. Telle, 13920 W. Alaska Dr., Lakewood, Colo. 80228

[21] Appl. No.: 58,650

[22] Filed: Jun. 2, 1987

Related U.S. Application Data

[63] Continuation of Ser. No. 725,629, Apr. 22, 1985, abandoned.

[51] Int. Cl.[4] ..... A63B 21/06

[52] U.S. Cl. ..... 272/117; 272/130

[58] Field of Search ..... 272/117, 118, 129, 130, 272/134, 143

[56] References Cited

U.S. PATENT DOCUMENTS

| | | | |
|---|---|---|---|
| 3,573,865 | 4/1971 | Annas et al. | 272/117 |
| 3,638,941 | 2/1972 | Kulkens | 272/130 |
| 3,731,922 | 5/1973 | Jungreis | 272/117 |
| 4,235,437 | 11/1980 | Ruis et al. | 272/130 |
| 4,354,676 | 10/1982 | Ariel | 272/130 |
| 4,357,010 | 11/1982 | Telle | 272/117 |
| 4,407,495 | 10/1983 | Wilson | 272/117 |
| 4,509,745 | 4/1985 | Angsten | 272/130 |
| 4,566,692 | 1/1986 | Brentham | 272/130 |
| 4,650,185 | 3/1987 | Cartwright | 272/117 |

*Primary Examiner*—Richard J. Apley
*Assistant Examiner*—J. Welsh
*Attorney, Agent, or Firm*—John E. Reilly

[57] ABSTRACT

An exercise apparatus combines a main support and a weight-lifting beam pivotally mounted thereon for movement about a horizontal axis, a weight-lifting bar adapted for releasable disposition of weights thereon and an adjustable support for pivotally supporting the weight-lifting bar on the main support including a member suspending the bar for movement in response to lifting and lowering of the weight-lifting beam member and an adjustable control for varying the distance of placement of the weight-lifting bar from the point of pivotal support. A hydraulic control circuit operates a hydraulic cylinder associated with the weight-lifting beam member to permit the athlete to closely and accurately control the degree of resistance imposed throughout each range of movement of an exercise. The control circuit can be remotely controlled by the athlete to impart either the same or varying amounts of resistance during a lifting and lowering sequence as well as to assist the athlete through a part or all of each sequence.

15 Claims, 3 Drawing Sheets

EXERCISE ISOKINETIC APPARATUS

RELATED INVENTIONS

This application is a continuation of Ser. No. 725,629, now abandoned filed Apr. 22, 1985, for EXERCISE APPARATUS, invented by Jerome R. Telle.

This invention relates to a novel and improved exercise apparatus; and more particularly relates to an exercise machine in which the resistance to an applied force can be closely and accurately controlled by the athlete in performing different exercises and at any position during the exercise including direction-changing phases.

BACKGROUND AND FIELD OF THE INVENTION

Numerous types of exercise machines have been devised in an attempt to establish optimal resistance to a force applied by the user throughout the entire exercise routine and in such a way as to overcome the need for the use of different exercise equipment in carrying out different specific exercises either in building muscles or increasing strength and endurance. Exercise machines of the constant force or isotonic variety customarily employ free weights. However, at some point in the course of each repetition of an exercise, the force will necessarily vary due to the ballistic nature of a free weight: Generally, varying the weight or body leverage in and of itself does not permit maximum effort during each phase of a repetition or movement. In this relation, varying strength levels of different athletes determines the need for resistance in accordance with a given strength level. Research indicates the advantages and benefits of being able to establish or vary the resistance in accordance with the athlete's strength output throughout an entire exercise, not just a portion of that exercise, and which permits the athlete to train to failure well past the limits of normal isotonic resistance.

Isokinetic exerciser apparatus in which the resistance is proportional to the force exerted have become increasingly popular in terms of permitting variation of the resistance imposed through a particular exercise movement and in controlling that resistance to be at a particular level. Isokinetic exercisers typically employ a hydraulic control system, dynamic braking system or clutch; however, exercisers of this type have certain limitations with respect to establishing a uniform resistance over the entire exercise program, particularly at the onset or completion of a particular movement.

Other exercise machines have employed other mechanisms, such as, cams in an effort to establish optimal resistance over the entire range of movement, but in general such mechanisms have been found to be extremely limited in application and are capable of providing only an average of a typical user's force profile notwithstanding that the profile will vary as a function of speed and fatigue. Furthermore, in exercise machines of the type employing a pump-powered pneumatic or hydraulic system, difficulties have been experienced in permitting the force profile to vary with individual variations in force, speed and range of movement.

I have previously devised exercising apparatus in which a weight bar is mounted for pivotal movement on a beam member of fixed length which is mounted in adjustably spaced relation to a lifting beam, and an isokinetic device in the form of a hydraulic cylinder is operative to limit the rate of movement in either direction of the weight bar by means of a valve arrangement which will change the direction from which the cylinder is operative to offer resistance to the movement. In this relation, reference is made to my U.S. Pat. No. 4,357,010. Apparatus has been devised by others will either electronically or hydraulically control the rate of movement of the apparatus by varying amounts and other representative patents in this field are U.S. Pat. Nos. 4,863,726 to R. J. Wilson; 4,307,608 to R. E. Useldinger et al; 4,184,678 to E. R. Flavell et al; and 4,235,437 to D. A. Ruis et al. To my knowledge, however, no one has devised exercise apparatus which can meet any resistance demand of the athlete in terms of force, position and time as a function of the athlete's force output during a particular exercise routine and of the athlete's previously recorded effort for that routine and fail to offer the proper level of resistance during direction change transitions, especially transition from a negative or downstroke to a positive or upstroke during each cycle. With respect to the athlete's force output, the athlete should not be able to move through an position too easily but on the other hand should not be restricted by too much resistance. In terms of previous recorded effort, it is desirable to be able to preset the resistance for a current exercise from past sessions as well as to increase or lessen the resistance according to past performance.

SUMMARY OF THE INVENTION

It is therefore an object of the present invention to provide for a novel and improved exercise apparatus which is extremely versatile and reliable and which is capable of establishing the highest possible resistance at every stage of the movement including transitional stages and over a wide variation in speed in performing each exercise.

Another object of the present invention is to provide for a novel and improved exercise machine which is capable of meeting different resistance demands of an athlete over a full range of movement during each exercise routine and which is self-compensating for variations in resistance demand during each routine.

A further object of the present invention is to provide in an exercise apparatus for a novel and improved method and means for sensing the force, position and rate of displacement of a weight in response to a particular force imposed by the athlete and of establishing a predetermined range of resistance in relation to that force.

Yet another object of the present invention is to provide a novel and improved exercise apparatus which is capable of providing feedback during and after each exercise routine, analization for correct resistance profiles as well as for future preset resistance settings and is further capable of modifying the resistance imposed during a particular exercise.

A still further object of the present invention is to provide in an exercise machine for a novel and improved system which will impart maximum resistance during the full range of each exercise either by precise changes in weight, fluid control or a combination of same.

In accordance with the present invention, there has been devised an exercise apparatus wherein there is provided, in combination with a main support and a weight-lifting beam pivotally mounted on the support for movement about a horizontal axis, a weight-lifting bar adapted for releasable disposition of weights thereon and adjustable support means for pivotally supporting the weight-lifting bar on the main support including means suspending the bar for movement in response to lifting and lowering of the weight-lifting beam member and adjustable control means for varying the distance of placement of the weight-lifting bar from the point of pivotal support. Preferably, the suspension means includes means for varying the spacing between the weight-lifting bar and weight-lifting beam member, and the adjustable control means is defined by a rotatable screw thread and means associated with the adjustable support means for linear advancement of the weight-lifting bar along the screw thread in response to rotation of the screw thread as well as drive means for rotating the screw thread which can be remotely controlled during the course of exercising to regulate or vary the effective weight of the beam members. Further, in the preferred form, isokinetic means is provided in the form of a hydraulic control circuit which operates through the medium of a hydraulic cylinder associated with the weight-lifting beam member to permit the athlete to closely and accurately control the degree of resistance imposed throughout each range of movement of an exercise. The control circuit can be remotely controlled by the athlete to impart either the same or varying amounts of resistance during a lifting and lowering sequence as well as to assist the athlete through a part or all of each sequence.

The above and other objects, advantages and features of the present invention will become more readily appreciated and understood from the foregoing detailed description of a preferred embodiment when taken together with the accompanying drawings, in which:

DETAILED DESCRIPTION OF THE PREFERRED EMBODIMENT

Figures 2, 3:
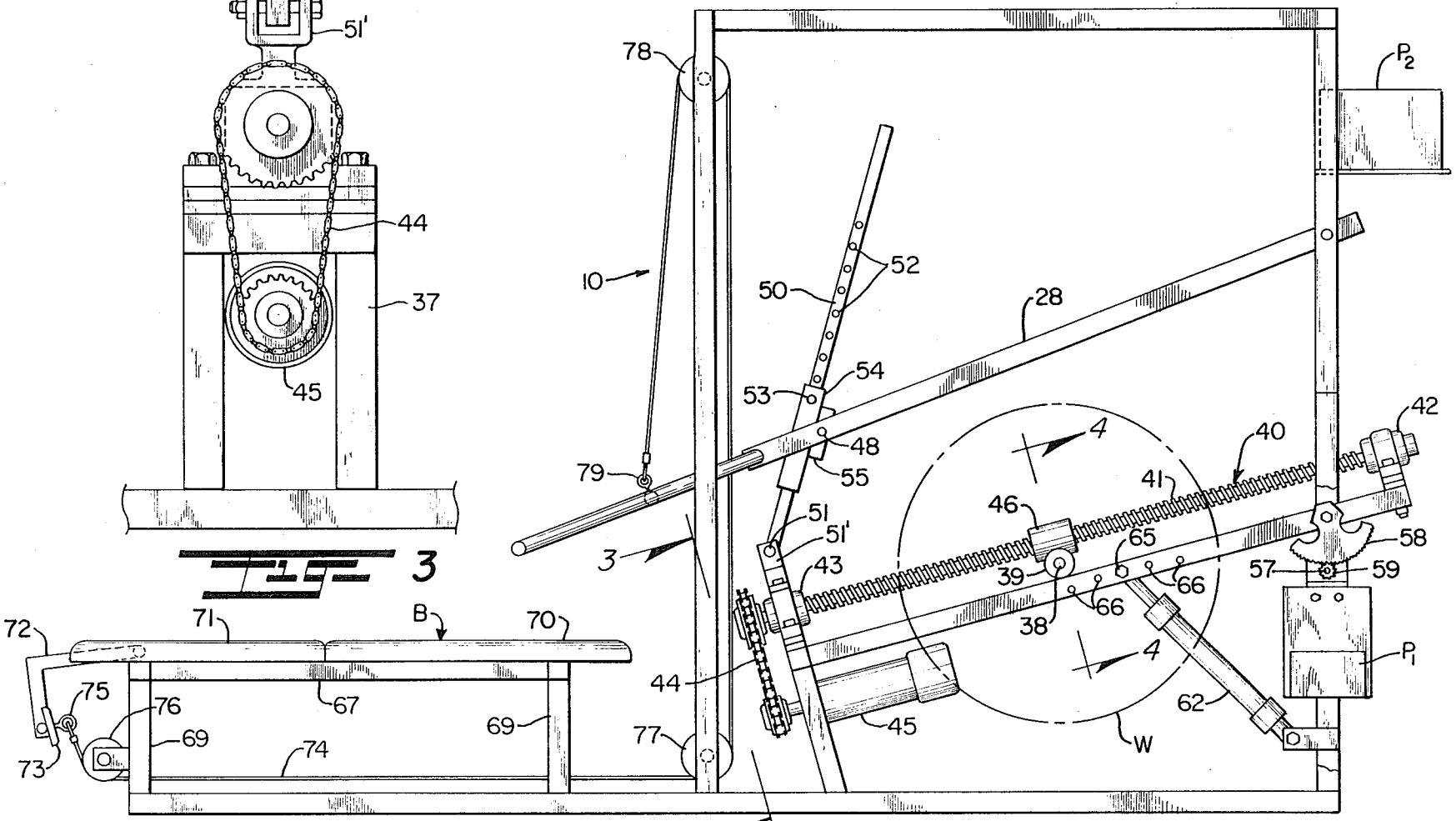
FIG. 2 is a side view in elevation of the exercise apparatus illustrated in FIG. 1.
FIG. 3 is an end view of the drive control for a drive screw forming a part of the present invention and taken about lines 3—3 of FIG. 2.

Referring in more detail to the drawings, there is shown in FIGS. 1 to 4 a preferred form of exercise apparatus 10 which is broadly comprised of a rectangular open base frame 12 having intermediate, closely-spaced crossbars 13 and an upright open frame support 14 forming the rearward end of said frame and having opposite vertical sides 15 and an upper crossbar 16. An intermediate open frame 18 has opposite vertical sides 19 and an upper support bar 20 for a pulley 21 and a rearwardly directed brace 22 which extends between the upper bar 20 of the intermediate frame and an upper rear support or auxiliary frame 23 on the frame 14. Positioned on the base frame intermediately of the sides 15 of the rear open frame 14 is an upstanding support 24 in the form of a solid vertical plate or block to which is pivotally secured a lower weight-lifting beam assembly 26. In turn, an upper weight-lifting beam assembly 28 is pivotally supported by a pivot shaft 29 for movement about a horizontal axis adjacent to the upper end of the rear support 23. The upper beam member 28 has spaced-apart parallel arms 28' which extend forwardly from their pivotal mounting on shaft 29 and terminate in a yoke or bifurcated end 32 having a cross brace 32' and spaced laterally extending handles 33. The handles 33 may be provided either with suitable hand grips and/or padding, not shown, to serve as shoulder pads in order to permit an exerciser to place his or her head between the handles and to rest the handles on the shoulders for lifting or lowering weights. The upper beam assembly 28 is dimensioned to be of a length such that the handles 33 project forwardly beyond the intermediate frame 18, and as illustrated in FIG. 2, are spaced above one end of a conventional weight-lifting bench B.

The lower weight-lifting beam 26 defines a weight support mechanism including spaced arms or bars 35 pivotally supported by pivot shaft 36 to the upper end of the lower support 24 with the arms normally inclining forwardly and downwardly therefrom to terminate in a forward end which rests on a vertical support brace 37, the latter extending upwardly and inclined somewhat forwardly from the rearwardmost crossbar 13.

A weight bar 38 extends transversely of the arm members 35 and is supported by rollers 39 on the arms 35 for linear advancement with respect to the arms under the control of a drive screw mechanism 40. The drive screw mechanism 40 includes a rotatable screw or threaded shaft 41 supported in pillow blocks 42 and 43 at opposite ends thereof. As shown in FIG. 3, a chain drive or other suitable form of power transmission 44 is operated by a drive motor 45 to impart rotation to the screw member 41. An internally threaded sleeve 46 projects from the weight bar 38 to intermeshingly engage the screw 41 and to impart linear advancement to the weight bar 38 in response to rotation of the screw 41.

In order to adjustably suspend the lower beam 26 from the upper beam 28, a height adjustment post 50 extends upwardly from pivotal connection at 51 to a yoke 51' at the front of the lower beam, there being a series of vertically spaced openings 52 in the post for selective insertion of a pin 53 through a rectangular sleeve 54. The sleeve has an offset portion 55 which is pivotally connected as at 48 to the upper beam 28.

Figures 1, 4:
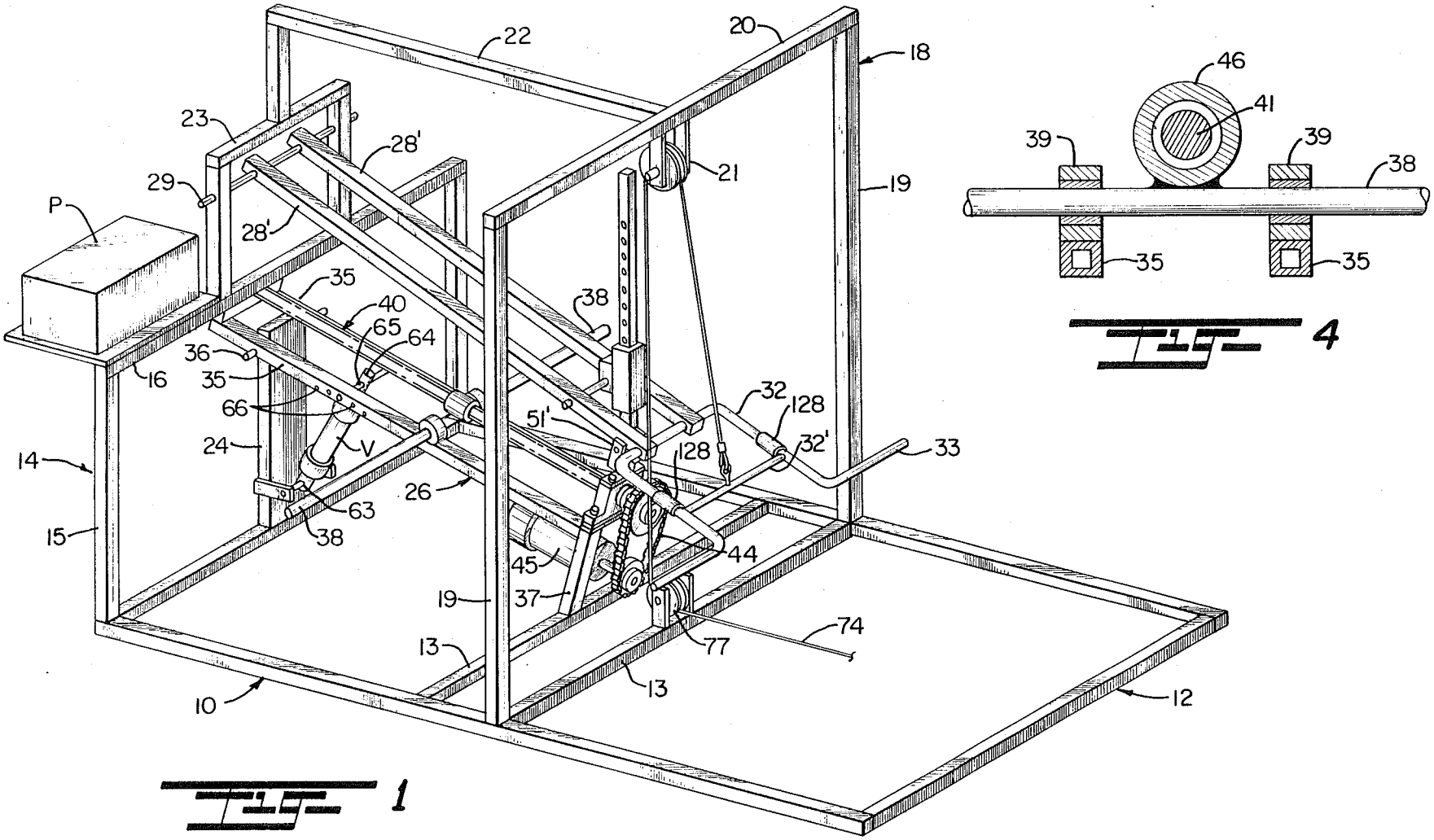
FIG. 1 is a somewhat perspective view of a preferred form of exercise apparatus in accordance with the present invention.
FIG. 4 is a cross-sectional view taken about lines 4—4 of FIG. 2.

As best seen from FIG. 2, a displacement sensor senses both the rate and distance of displacement of the lower beam in response to lifting of the upper beam and preferably is in the form of a semi-circular rack 58 which intermeshingly engages a gear 59 on a shaft 57. Pivotal or swinging movement of the rack 58 will impart rotation via gear 59 into the shaft 57 and which angular displacement and rate of movement in either direction is sensed and delivered through electrical leads, not shown, to a potentiometer represented at $P_1$. This potentiometer reading gives the position of the handlebars at any point in time. The velocity of the handlebars may be derived by taking the first derivative of that position with respect to time. A second potentiometer P2 is mounted at the end of the screw member 41 to sense the rate and number of revolutions of the screw member 41 and to transmit same via electrical leads, not shown, to an A/D converter 126. As shown in FIG. 1, load cells 128 are shown mounted on opposite sides of the yoke 32 for a purpose to be hereinafter described.

In order to impart a controlled resistance to pivotal movement of the lower beam both in an upward and downward direction a hydraulic control cylinder 62 has its lower cylinder end 63 pivotally connected to the lower end of the support 24, and the upper rod end 64 of the cylinder is pivotally connected to a support bar 65 beneath drive screw 41. Preferably, the support bar 65 which is mounted on the lower beam assembly, can be inserted through one of a series of spaced openings 66 arranged in a somewhat circular array to permit adjustment of the angular and upward extension of the cylinder and in this manner will assist in regulating the degree of resistance imposed by the cylinder 62 for a given amount of hydraulic force or resistance developed in the cylinder 62 under the control of a hydraulic circuit.

As shown in FIG. 2, a bench B is positioned at the forward end of the frame 12 having legs 69 and an upper frame 67 supporting an adjustable padded portion 70 and stationary padded surface portion 71. Extension arms 72 of a leg lift exerciser on opposite sides of the padded surface portion 71 are provided with foot-engaging pads 73. Various exercises can be carried out through direct manipulation of the handles 33 when the athlete stations himself in a seated or prone position on the padded surface portion 70 by lifting and lowering of the upper beam member 28 against the resistance imposed by the lower beam 26, including any weights W added to the weight bar 38 and any hydraulic resistance imposed by the cylinder 62 in a manner hereinafter described. In the alternative, various additional exercises can be carried out through the manipulation of the remote exerciser arms 72 or other suitable attachments at the forward end of the bench B via a remote control cable system 74. To this end, the remote control cable 74 is attached at one end 75 to the extension arm 72 and is trained around pulley 76 affixed to the forward end of the frame 12, pulley 77 affixed to the lower crossbar 13 and upper pulley 78 affixed to the upper crossbar 20 of the frame 18. The cable 74 has one end affixed to an eyelet 79 on the yoke member 32 of the upper beam 28 to translate any lifting or lowering movement of the extension arms 72 into the upper beam 28.

Figure 5:
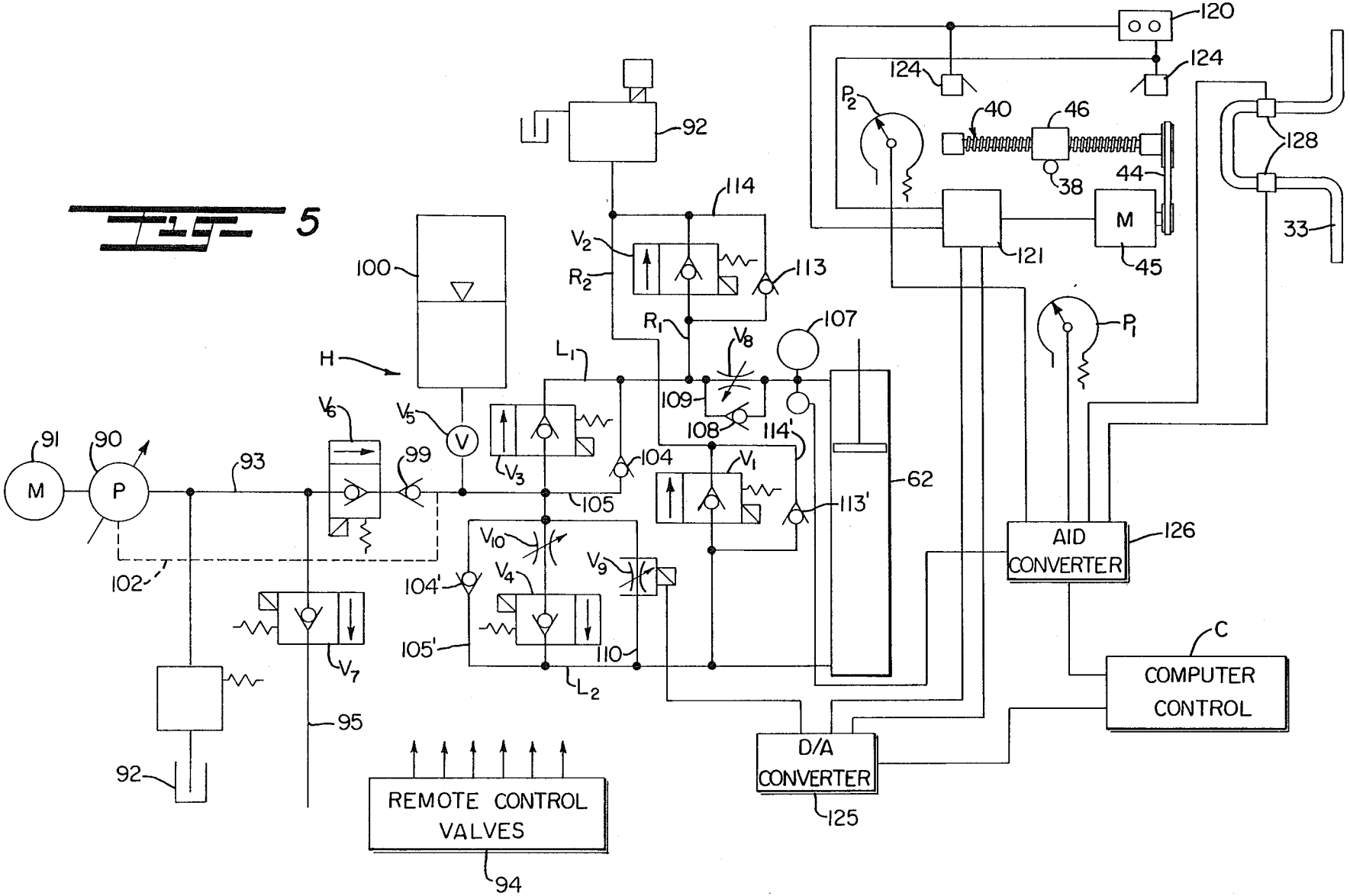
FIG. 5 is a schematic view of a preferred form of hydraulic control circuit employed in association with the preferred form of exercise apparatus.

In exercises carried out either through direct manipulation of the handle 33 or via the remote cable system, an important feature of the present invention resides in the automatically controlled, variable resistance imposed by the hydraulic control circuit H through the medium of the hydraulic cylinder 62. To this end, the preferred form of hydraulic control circuit H is capable of selectively regulating the resistance imposed during an exercise both on the upstroke and downstroke of the beam 28 and in such a way as to be self-compensating in response to variations in the force applied by the exerciser or athlete for a given speed or rate of displacement in the course of an exercise. As illustrated in FIG. 5, a variable flow pump 90 is driven by a constant speed motor 91 to draw fluid from reservoir 92 and deliver same via pressure line 93 either through line $L_1$ to the upper end of the cylinder 62 or through line $L_2$ to the lower end of the cylinder. In the pressure line 93, a closed center flow control valve $V_7$ in line 95 is operative to regulate return flow of fluid back to the reservoir 92 in the event that the pressure in the line exceeds a specified level as sensed by pressure sensing line 102 or in the event that a closed center flow control valve $V_6$ in the line 93 is preset to a closed position. Assuming that the valve $V_6$ is preset to an open position, hydraulic fluid under pressure is delivered from the line 93 to either of the pressure lines $L_1$ or $L_2$ depending upon which flow control valve $V_3$ or $V_4$ is preset to an open position, each of the flow control valves $V_3$ and $V_4$ being closed center valves as indicated. A check valve 99 in the line 93 prevents reverse flow of fluid through the line 93. The pressure in the line 93 may be boosted by an accumulator 100 having a manual on/off control valve $V_5$ and which is connected into the pressure line 93 upstream of the branch lines $L_1$ and $L_2$. A check valve 104 in bypass line 105 serves to permit return flow of fluid from the upper pressure line $L_1$ back to the accumulator. Similarly, a check valve 104' in bypass line 105' permits reverse flow of fluid from the line $L_2$ back to the accumulator 100. Preferably, the accumulator is of the piston type so that accumulator pressure may be increased in response to fluid under pressure returned from the cylinder as described. A throttle valve $V_8$ in the line $L_1$ is adjustable to control the amount of pressure of fluid out of the upper end of the cylinder, and a pressure gauge 107 is provided to afford a visual reading of the pressure in the line.

It will be noted that a check valve 108 is positioned in bypass line 109 to bypass the throttle valve for return flow of fluid from the upper end of the cylinder 62. A modulated or adjustable throttle valve $V_{10}$ is positioned in the line $L_2$ upstream of the flow control valve $V_4$ to regulate pressure in the line $L_2$ when fluid is to be delivered into the lower end of the cylinder. If both flow control valves $V_3$ and $V_4$ are closed, fluid under pressure is delivered from the upper end of the cylinder through bypass line 110 to the line $L_2$ and which line 110 includes a modulated or adjustable throttle valve $V_9$ to regulate the maximum fluid pressure deliverable out of the upper end of the cylinder under those conditions. Return or reverse flow of fluid from the lower end of the cylinder 62 is directed through the check valve 104' in line 105' for return to the accumulator 100 when the valve $V_5$ is open.

In the event that either valve $V_1$ or $V_2$ is open, fluid is caused to return either from line $L_2$ or $L_1$, respectively, to the above-line reservoir 92 as follows: A return line $R_1$ communicates with pressure line $L_1$ downstream of the check valve 108 and which return line is provided with a normally closed center flow control valve $V_1$ leading to the reservoir 92. A check valve 113 in bypass line 114 serves to bypass the flow control valve $V_2$ for reverse flow of fluid from the reservoir. Correspondingly, a return line $R_2$ communicates with line $L_2$ directly downstream of the lower end of the cylinder and has a flow control valve $V_1$ together with a check valve 113' in bypass relation to return line $R_2$ via line 114'. Thus, depending upon which of the lines $L_1$ or $L_2$ operates as the pressure line for delivery of fluid to one end of the cylinder, the other of the lines $L_1$ and $L_2$ permits return of fluid through a respective return line $R_1$ and $R_2$ directly to the reservoir. Opening and closing of the flow control and throttle valves $V_1$ to $V_{10}$ is electrically controlled in a conventional manner through control switches 94 electrically connected to solenoid or pilot control elements associated with each of the valves. For example, each of the flow control valves $V_1$ to $V_7$ may be a Fluid Power System Solenoid Valve Model XC19B-2,3 and 6T manufactured and sold by Fluid Power Systems, Wheeling, Illinois 60090. The throttle valves $V_8$ to $V_{10}$ each may be a Marsh Seat Needle Valve Model N1513 manufactured and sold by Marsh Instrument Company, Skokie, Ill. 60076.

The versatility of the hydraulic control system in establishing the desired resistance to the various exercises to be performed can be best understood and appreciated from a consideration of the following Table of different mode sequences which can be selected by the athlete in carrying out particular exercise programs:

TABLE I

| | Mode Sequence | Valve Numbers V1 | V2 | V3 | V4 | V5 | V6 | V7 | V8 | V9 | V10 | Accumulator | Pump |
|---|---|---|---|---|---|---|---|---|---|---|---|---|---|
| I | Normal | C | C | C | C | C | C | C | | | | on | on |
| | Preset | O | | O | | O | O | | | | x | | |
| | A Pressurize accumulator | | | | | | | | | | | | |
| | (1) Pump | | | | | | | | | | | on | on |
| | (2) Athlete | | | C | | | | | | | | on | off |
| | B Workout | | | | | | | | | | | on | off |
| | C Decrease Pressure | | | | O | | | | | o | | on | off |
| II | Preset | O | C | C | O | O | C | O | | | x | on | on |
| | A Start in Up position | | | | | | | | | | | | off |
| | B Pump pushes down | | | O | C | | O | C | | | x | on | on |
| | C Athlete pushes against accumulator and V10 | O | | | O | | C | O | | | x | on | off |
| III | Preset | O | O | C | | C | | O | | | | off | on |
| | A Pump assist on up stroke | C | | C | O | | O | C | | | | off | on |
| | B No effect | | | | | | | | | | | off | off |
| | C Extra resistance on downstroke | | C | O | | | O | C | | | | off | off |
| IV | Preset | O | O | | | O | | | x | | x | | |
| | A Pressurize accumulator on downstroke | C | | | | | | | | | | on | off |
| | B Workout | | | | | | | | x | | | | |
| | C Help on upstroke | C | | | | O | | | | | x | on | off |

From Table I, it will be noted that all valves $V_1$ to $V_7$ are normally closed with selected of the valves preset to an open position to carry out a particular exercise or mode sequence, a "O" appearing where indicated beneath the valves to designate that the valve is preset to an open position. Throttle valves $V_8$ and $V_{10}$ are preset manually to establish a predetermined rate of flow; and valve $V_9$ is preferably controlled as a function of the speed of the upstroke and downstroke of the lift beam and transmitted via control line 110 from the D/A converter 125.

By way of illustration, in mode sequence I, with the valves preset as shown the accumulator 100 can be pressurized to a workout level either by the pump or by the athlete on the upstroke of the beam assembly. Pressure can be reduced by the athlete opening valve $V_4$ via remote control switch as indicated at 94. Thus, in mode I, the resistance is established by accumulator back pressure, such as, by operation of one of the switches 94 or by the computer opening valve $V_9$ through the converter 125 as shown both for upward and downward movements of the weight bar. Again, the desired amount of resistance can be generated either by operation of the pump 90 or pressurization of the accumulator 100 by the athlete or computer control. As the athlete proceeds through his workout under the conditions indicated at IB, he may at any point selectively decrease the pressure by opening the valve $V_4$ as at 1C.

In mode sequence II, the valves $V_1$ to $V_7$ are preset as shown for the athlete to exercise against the resistance provided by the pump and accumulator on the downstroke and against the accumulator and preset valves $V_8$ or $V_{10}$, or both, on the upstroke. As noted from IIB, the pump when activated will cause the piston to force the beam assembly 28 down against the resistance of the athlete. At IIC, by presetting the valves as shown and deactivating the pump, the athlete will overcome the resistance of the accumulator on the upstroke. Accordingly, it will be seen that in mode II the pump overcomes the resistance of the athlete on the downstroke, and the accumulator pressure offers the resistance through valve $V_4$ on the upward or extension stroke, the purpose being to maintain a continuing amount of tension in the muscles during the entire movement including the transitions in changing directions. The accumulator 100 establishes the desired tension in transition and at the same time prevents shock on the downstroke; and the accumulator pressure, to an extent, is regulated according to the amount of force applied by the athlete.

As shown in mode sequence III, the pump is activated with the valves preset as shown to lend assistance on the upstroke. Here the pump may be used together with weights either to add resistance on the downstroke or to assist on the upstroke. Mode III is distinguishable from modes I and II in that it is possible to establish regular isotonic resistance throughout the upstroke and downstroke while making the weight heavier on the downstroke and lighter on the upstroke, or vice versa.

In mode sequence IV, the accumulator is pressurized on the downstroke and when desired aids on the upstroke. Here, weights are added so as to assist in pressurizing the accumulator on the downstroke for assistance later on the upstroke. Thus, the resistance established in mode IV is defined by the weight bar and, as the athlete fatigues, the weight may be lightened by first storing pressure in the accumulator on the downstroke and which will then assist the athlete, or lighten the load, on the upstroke.

In the course of exercising and as further illustrated in FIG. 5, the drive screw mechanism 40 for the weight bar 38 is operated and controlled independently of the hydraulic control circuit by remote control switches 120 directed into an electrical control panel 121 which routes or delivers signals from the control switch 120 to the electric motor drive 45 for the power transmission unit 44 at one end of the screw and to a D/A converter as represented at 125. Although not illustrated, a suitable display is provided to indicate the movement or position of the weight bar and which may provide a readout of the effective weight in relation to the position or moment arm of the weight bar away from the pivotal end of a drive screw. Limit switches 124 are disposed at opposite ends of the drive screw to automatically brake or deactivate the motor drive 45 in the event that the weight bar should reach its end limit of movement in either direction. The potentiometer $P_2$ affords a reading of the speed and distance of movement of the weight bar in response to energization of the motor 45 via an A/D converter as represented at 126, and the potentiometer $P_1$ similarly directs signals into the A/D converter 126 to provide a reading of the rate of angular displacement of the lower beam 26 in response to lifting or lowering of the beam assembly during an exercise routine. Load cells 128 provide weight readings which are directed as inputs into the computer, as shown in FIG. 5, and are preferably positioned on the handlebar or to sense the amount of effective weight at the end of the beam assembly 28. In use, the athlete can position himself at either end of the bench in order to perform a given exercise utilizing either the remote control system or by direct engagement with the lift beam assembly. The remote control switches 94 for the valves and the switch 120 for the drive screw mechanism 40 are within easy reach so as to enable the athlete to preset the machine to a desired weight level and resistance, respectively. Weight level changes can be carried out by placing a set of weights on the weight bar 38 or by advancing the drive screw mechanism to position the weight bar a specific distance away from the pivotal end. As the athlete proceeds through a given routine, the position of the weight bar or screw can be changed as desired by remote control of the motor 45 to modify the effective weight, for example, if the athlete should sense or feel that the rate of lifting or lowering of the beam member is either too fast or too slow. Similarly, the resistance level may be altered as previously described via switches 94 or automatically in response to a software program entered into the computer control. The potentiometer readings into the A/D converter 126 can be displayed to reflect any such changes in weight resistance or rate of movement.

The system as described lends itself well to manual control or automatic control, for example, by software programs employed in cooperation with a computer to enter various changes in resistance or weight level as the athlete progresses through a given exercise or routine. To this end, it will be evident that various programs and computer controls may be utilized and, as such, form no part of the present invention. To illustrate the foregoing, the control parameters entered by the user via the remote control switches 94 can be passed through the A/D converter 126 and stored in a conventional manner in memory devices contained in computer C. These parameters may be continuously compared by the computer C to actual readings received from the remote sensing devices via the A/D converter 126. Appropriate firmware means can be employed by the computer to generate error signals which are translated into control signals and fed via the D/A converter 125 to various elements in the hydraulic circuit H, thereby maintaining the desired level of resistance. Depending upon the exercise routine and number of repetitions, one of the four modes I to IV may be selected by presetting the valves in accordance with the illustrations given in the foregoing Table. As the athlete progresses through a selected routine, as noted earlier, the resistance may be changed through activation of the remote control switches 94 to change the valve settings as indicated in the Table. For instance, in mode I, resistance or pressure may be decreased by opening valve $V_4$. Similarly, in mode II, resistance may be varied by opening valves $V_4$ and $V_7$ and closing valve $V_6$. In mode III, extra resistance may be developed on the downstroke by closing valves $V_2$ and $V_7$ while opening valves $V_3$ and $V_6$. In mode IV, the resistance may be reduced on the upstroke by closing valve $V_1$ and opening valve $V_4$. In each case, the valves can be individually controlled by a remote control panel 94 provided with control buttons within close reach of the athlete. As noted earlier, the resistance can be varied by shifting the connection of the cylinder rod 64 with respect to the openings 66.

The foregoing modes or sequences are described more for the purpose of illustration and not limitation; and it will be evident that various modes may be devised in performing different exercises. For instance, isotonic resistance can be increased or decreased by changing the movement of the weight bar. This may be further modified by adding a static or preset hydraulic resistance to control coasting at the end of a stroke. In other modes, if the force is too low at the end of the upstroke, the pump can be activated before the stroke is completed. In this regard, as fatigue sets in, less pressure will be needed in the downstroke and accordingly less pressure will be applied on the ensuing upstroke.

Although the present invention has been described with particularity relative to the foregoing detailed description of the preferred embodiment, various modifications, changes, additions and applications other than those specifically mentioned herein will be readily apparent to those having normal skill in the art without departing from the spirit and scope of this invention as defined by the appended claims.

I claim:

1. In exercise apparatus wherein there is provided a support frame for a first beam member which is pivotally mounted adjacent to one end thereof on said support frame for pivotal movement about a horizontal axis and said first beam member having a free end adapted to be grasped by a weight-lifter in lifting and lowering a weight suspended from said first beam member, the improvement comprising:

a second beam member pivotal on said support frame in vertically spaced relation to said first beam member and a weight-lifting bar on said second beam member including means for releasably supporting varying amounts of weights thereon;

suspension means for suspending said second beam member from said first beam member for movement in response to lifting and lowering of said free end of said first beam member, and adjustable control means for varying the distance of said weight-lifting bar with respect to said pivotally connected end of said second beam member whereby to vary the effective weight of said first and second beam members, said adjustable control means including a rotatable screw member extending parallel to said second beam member, means for imparting linear advancement to said weight-lifting bar along said screw thread member in response to rotation of said screw member, and drive means for rotating said screw member; and resistance means for imparting a variable resistance to pivotal movement of said first and second beam members and said suspension means as they are lifted and lowered by a weight-lifter, said resistance means including a fluid cylinder and piston interposed between one of said first and second beam members and said support frame, and fluid control circuit means operative to regulate the pressure of fluid in said cylinder.

2. In exercise apparatus according to claim 1, said suspension means including means for selectively adjusting the vertical spacing between free ends of said first and second beam members.

3. In exercise apparatus according to claim 1, said adjustable control means including indicator means responsive to rotation of said screw member to indicate the distance of said weight-lifting bar from said support frame.

4. In exercise apparatus according to claim 1, including potentiometer sensing means for sensing the speed and distance of movement of said weight-lifting bar in response to lifting and lowering of said first and second beam members.

5. In exercise apparatus according to claim 1, said fluid control circuit means operative to control the fluid pressure delivered to opposite ends of said cylinder as said first and second beam members are lifted and lowered to advance said piston through said cylinder.

6. In exercise apparatus according to claim 5, said fluid control circuit means including a pump and accumulator, and means for storing pressure in said accumulator selectively in response to delivery of fluid under pressure by said fluid flow control circuit means and alternately in response to manual application of force of said beam members by the weight-lifter.

7. In exercise apparatus wherein there is provided a main frame for a beam assembly which is pivotally mounted at one end for movement about a horizontal axis in response to lifting and lowering of said beam assembly by a weight-lifter and a weight-lifting bar is suspended from said beam assembly including means for supporting weight members on said bar, the improvement comprising:

a double-acting fluid cylinder and piston extending between said beam assembly and said frame, and fluid control circuit means including accumulator means for regulating the fluid pressure in said cylinder whereby to impart a preset variable resistance to movement of said beam assembly and said weight-lifting bar as said beam assembly is lifted and lowered by the weight-lifter, said fluid control circuit means controlling the fluid pressure delivered to opposite ends of said cylinder as said beam assembly is lifted and lowered to advance said piston through said cylinder, and on/off control means for selectively activating said accumulator means to increase the fluid pressure in said fluid cylinder selectively in response to delivery of fluid under pressure by said fluid flow control circuit means and the application of force to said fluid cylinder by the weight-lifter in lifting or lowering said beam assembly.

8. In exercise apparatus according to claim 7, including adjustable control means for selectively varying the distance of said weight-lifting bar from the pivotal end of said weight-lifting beam assembly whereby to vary the effective weight of said beam assembly.

9. In exercise apparatus according to claim 8, said cylinder being adjustably connected at one end to said beam assembly, said adjustable control means defined by a rotatable screw member and means for imparting linear advancement to said weight-lifting bar along said screw member in response to rotation of said screw member, and drive means for rotating said screw member.

10. In exercise apparatus according to claim 9, said adjustable control means including means for sensing the speed and distance of movement of said beam assembly as it is lifted and lowered, and remote control means for selectively activating said drive means to advance said weight-lifting bar in either direction along said screw member.

11. In exercise apparatus according to claim 7, said fluid control circuit means having pilot operated control valves for selectively increasing and decreasing the fluid pressure delivered to one end of said fluid cylinder whereby to selectively vary the resistance to movement of said beam member in one direction only.

12. In exercise apparatus according to claim 7, including adjustable valve means to regulate the maximum fluid pressure deliverable from said cylinder.

13. In exercise apparatus according to claim 7, including means for pressurizing said accumulator in response to the application of force to said cylinder by the weight-lifter during the downstroke of said weight-lifting bar whereby said accumulator will aid in lifting said weight-lifting bar on the upstroke.

14. In exercise apparatus according to claim 7, said weight-lifting beam assembly including spaced-apart hand grip members at said free end, and a bench beneath said beam assembly.

15. In exercise apparatus according to claim 14, said bench including a pivotal lift member at one end of said bench remote from said free end of said beam assembly, and remote control cable means extending from said pivotal lift member including means for guiding and connecting said cable to said beam member to impart lifting of said pivotal lift member on said bench to said beam member.

* * * * *